United States Patent [19]

Rockman et al.

[11] 4,430,779

[45] Feb. 14, 1984

[54] APPARATUS FOR STEAM CONDITIONING TEXTILE FABRICS

[76] Inventors: Lawrence Rockman, 614 Woodbury Rd., Plainview, N.Y. 11803; Peter Haft, 140 Kensington St., Brooklyn, N.Y. 11235

[21] Appl. No.: 223,994

[22] Filed: Jan. 12, 1981

Related U.S. Application Data

[63] Continuation-in-part of Ser. No. 29,029, Apr. 11, 1979, abandoned.

[51] Int. Cl.[3] ..... D06C 5/00; D06C 7/00

[52] U.S. Cl. ..... 26/18.5; 26/81; 26/84; 68/5 B

[58] Field of Search ..... 26/18.5, 81, 82, 84; 68/5 B, 5 D, 6

[56] References Cited

U.S. PATENT DOCUMENTS

| | | | |
|---|---|---|---|
| 2,944,317 | 7/1960 | Cohn et al. | 26/18.5 |
| 3,175,272 | 3/1965 | Cohn et al. | 26/84 |
| 3,177,555 | 4/1965 | Clapp et al. | 68/5 D X |
| 3,257,735 | 6/1966 | Catallo | 26/81 |
| 3,703,882 | 11/1972 | Haft | 26/82 X |
| 3,762,003 | 10/1973 | Frezza | 26/81 |
| 3,875,624 | 4/1975 | Frezza | 26/81 |
| 3,971,235 | 7/1976 | Frezza | 26/81 X |
| 4,014,081 | 3/1977 | Bryan | 26/18.5 |
| 4,044,434 | 8/1977 | Bryan | 26/18.5 |
| 4,134,188 | 1/1979 | Bryan | 26/18.5 |
| 4,146,946 | 4/1979 | Plaia et al. | 26/18.5 |

*Primary Examiner*—Robert Mackey

*Attorney, Agent, or Firm*—Thomas R. Morrison

[57] ABSTRACT

An apparatus for the steam conditioning of lengths of textile fabrics includes a frame carrying a fabric spreader for spreading of the fabric in a spreading zone, steam boxes for application of steam to the spread fabric within a steam zone, a cooling zone, and fabric advancing mechanism for advancing the fabric through the steam and cooling zones. A duct system encloses the steam boxes and, in conjunction with one or more blowers, evacuates steam upwardly and downwardly from a region adjacent the steam boxes thereby confining the steam zone to the region between the discharge sections of the steam boxes and preventing the migration of steam to areas upstream and downstream of such steam zone.

9 Claims, 6 Drawing Figures

APPARATUS FOR STEAM CONDITIONING TEXTILE FABRICS

This application is a continuation-in-part of application Ser. No. 06/029,029 filed Apr. 11, 1979, now abandoned.

BACKGROUND OF THE INVENTION

The invention relates to process and apparatus for the steam conditioning of lengths of textile fabrics. More particularly, the invention is concerned with application of such process and apparatus to the steam conditioning of lengths of knitted sweater fabric which may optionally be flat or tubular and may comprise a series of tubular sweater sections, each consisting essentially of body and waistband or cuff segments. Successive sweater sections are connected by means such as draw threads, and in the steam conditioning of such sweater sections, the cuff or waistband segments should not be exposed to steam while in a spread condition.

The vast majority of sweaters are fabricated today by being knit in continuous manner on tubular knitting machines although significant quantities of sweaters are also produced on flat-bed knitting machines. The process of this invention, as well as the apparatus thereof, is applicable to the conditioning of such fabrics as well as other fabrics where accurate control of the application of steam to selected portions of the fabric is of importance. It will, therefore, be appreciated that although the invention will be described with relation to tubular knitted fabric, the invention is not to be construed as being limited to such fabric.

In the production of knitted sweater fabric, it is customary to employ a first type of stitch to form the body segment of the sweater. The most popular type of stitch used for this purpose is the jersey stitch. The waistband or cuff segment of the sweater is frequently formed with a rib stitch since rib stitch fabric is characterized by excellent widthwise elasticity. Thus, yarn which possesses relatively little inherent elasticity can be used to advantage in this segment of the sweater. The sweater sections are linked together to form the continuous length of fabric by means of the insertion of draw threads interconnecting marginal portions of the waistband or cuff of one sweater section with the body of the next succeeding sweater section.

It has been generally recognized that after knitting of the sweater fabric, it is desirable to steam condition such fabric, specifically the body segments thereof in order to achieve dimensional stability. A variety of processes and apparatus are presently in use for the steam conditioning of the fabric, the trend being toward the use of apparatus which will obviate the requirement for individual handling of each sweater coating e.g., the separate mounting of each sweater section on the fabric spreader and separate recovery of each such sweater section from the discharge end of the apparatus. U.S. Pat. No. 2,944,317 issued July 12, 1960 discloses a typical prior art machine for steam conditioning lengths of sweater fabric. As disclosed therein, the fabric is mounted on a spreader, and the spread fabric is advanced sequentially through a steam zone and a cooling zone for discharge onto a take-out mechanism for folding or rolling.

One of the major problems encountered in the steam conditioning of sweater fabrics described above resides in maintaining the dimensional stability of the fabric both longitudinally and transversely thereof as the fabric is advanced through the machine. The problem appears to stem at least partially from the fact that it has not heretofore been possible to effectively control the migration of steam from the steam zone to other regions of the machine at which locations the steam penetrates the fabric and adversely affects the desired setting of the yarns. Furthermore, by not being able to accurately confine the steam to a prescribed steam zone, the cuff or waistband segments of the sweater fabric become exposed to steam while in a spread condition with the result that such segments of the sweater lose some degree of the resiliency which they require when worn. Thus, it will be seen that because of the inability of prior machines to effectively control the migration of steam from the steam zone, control of the lengths and width of the sweater sections as well as desired transverse alignment of the knitting courses has become extremely difficult and at best uncertain.

Another problem arising in the use of steam conditioning machines designed to process continuous lengths of sweater fabric has been the tendency of the fabric to bunch up as it is transferred from the endless belt of the spreader to the endless belt of the fabric advancing mechanism. Such bunching of the fabric in the region of the machine preceding the steam zone has the disadvantage that the sensing elements of the machine for sensing the approach of a cuff of waistband segment of a sweater section and activation of steam cut-off in the steam zone during the passage of such cuff or waistband segment therethrough are rendered either inoperative or at the least less effective. This results in a failure of such steam control elements to accurately effectuate steam cut-off and in steam conditioning of the cuff or waistband segments. Such sweater sections frequently do not achieve the desired dimensional stability and the cuff or waistband segments do not exhibit the intended resiliency. These sweaters are, therefore, severely limited in terms of quality and style.

Another disadvantage of existing steam conditioning machines derives from drivable engagement of the edge drive rolls with the rollers of the fabric spreader in proximity of the steam zone where migrating steam creates a region of elevated temperature. Marking, pressing and shining of the fabric frequently results. This phenomenon is particularly acute when the fabric being processed is heat-sensitive such as is true of the acrylic fabrics.

The importance of confining the steam to a precisely defined zone has been recognized heretofore but, as a practical matter, has been unattainable. U.S. Pat. No. 2,944,317, for example, resorts to the use of steamers having a single discharge slot. However, the patentees also recognized that this would probably, in itself, be insufficient to overcome the problem and that some degree of steam migration would persist. A nozzle arrangement was, therefore, provided adjacent to and upstream of the steamers for sending a blast of air across the fabric. The patentees additionally provided for intermittent operation of the steamers in an effort to avoid steaming of the waistband portions of the sweater fabric. In practice, however, optimum control of the steamers has proven elusive. This is at least partially attributable to the tightness and consequent high density of the fabric in the region of the draw threads between the sweater sections. The difficulty exists regardless of whether one or more draw threads are utilized.

OBJECTS AND SUMMARY OF THE INVENTION

Accordingly, it is an object of the invention to provide process and apparatus for steam conditioning textile fabric by accurately controlling application of steam to the fabric so as to avoid steaming segments of the fabric not intended to be so treated.

It is another object of the invention to provide process and apparatus for steam conditioning continuous lengths of knitted tubular interconnected sweater sections whereby application of steam to cuff or waistband segments of each sweater section is avoided and the migration of stream from the steam zone is prevented.

It is still another object of the invention to provide both process and apparatus for the steam conditioning of continuous lengths of knitted textile fabric whereby bunching up of the fabric in the region where the fabric is transferred from the fabric spreader to the fabric advancing mechanism is prevented.

It is yet another object of the invention to provide apparatus for the steam conditioning of continuous lengths of textile fabric which is operable at lower temperature levels.

It is a further object of the invention to provide both process and apparatus for the steam conditioning of continuous lengths of textile fabric which eliminates staining of the fabric by steam condensate.

According to an aspect of the present invention, there is provided an apparatus for steam conditioning a fabric comprising means for spreading the fabric in at least a transverse direction, an upper steam box spaced a first predetermined distance above the upper surface of the entire transverse dimension of the spread fabric, a lower steam box spaced a second predetermined distance below the lower surface of the entire transverse dimension of the spread fabric and in superposed relationship to the upper steam box, first steam means centered in the upper steam box and spaced the first predetermined distance above the upper surface for discharging steam in a first steam line across the entire transverse dimension of the upper surface, an upper steam exhaust passage adjacent the first steam means along at least the entire length of the first line, the upper steam exhaust passage defining an outer boundary of the upper steam box, blower means effective to withdraw substantially all of the steam delivered by the first steam means through the upper steam exhaust passage whereby the steam is prevented from migrating horizontally and is confined to at most the outer boundary of the upper steam exhaust passage, second steam means centered in the lower steam box and spaced the second predetermined distance below the lower surface for discharging steam in a second line across the entire transverse dimension of the lower surface, a lower steam exhaust passage adjacent the second steam means along at least the entire length of the second line, the lower steam exhaust passage defining an outer boundary of the lower steam box, the blower means being further effective to withdraw substantially all of the steam delivered by the second steam means through the lower exhaust passage whereby the steam is prevented from migrating horizontally and is confined to at most the outer boundary of the lower steam box, means for providing relative motion between the fabric and the upper and lower steam boxes in a direction at right angles to the transverse direction whereby the first and second lines are moved relative to the fabric, and means for simultaneously stopping the relative motion and the first and second means for delivering steam at a predetermined relationship of the fabric and upper and lower steam boxes whereby at least a predetermined portion of the fabric outside the outer boundaries of the upper and lower steam boxes remains free from the steam conditioning.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
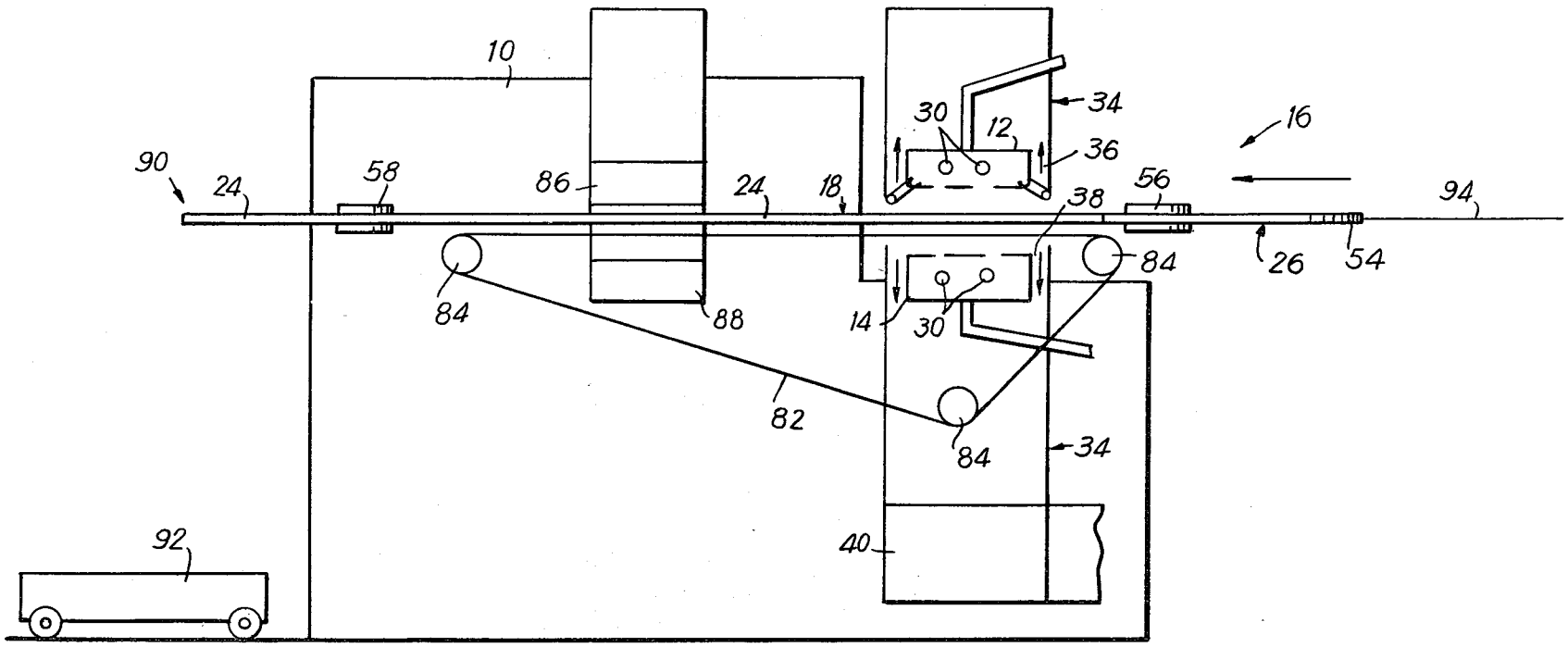
FIG. 1 is a simplified schematic side elevational view of a machine for steam conditioning of textile fabric according to an embodiment of the invention.

Before explaining the invention in detail, it is to be understood that the invention is not limited in its application to the details of construction and to the arrangement of parts illustrated in the drawings since the invention is capable of other embodiments and of being practiced or carried out in various ways. It is to be further understood that the phraseology or terminology employed is for purpose of description only and not of limitation.

Figure 2:
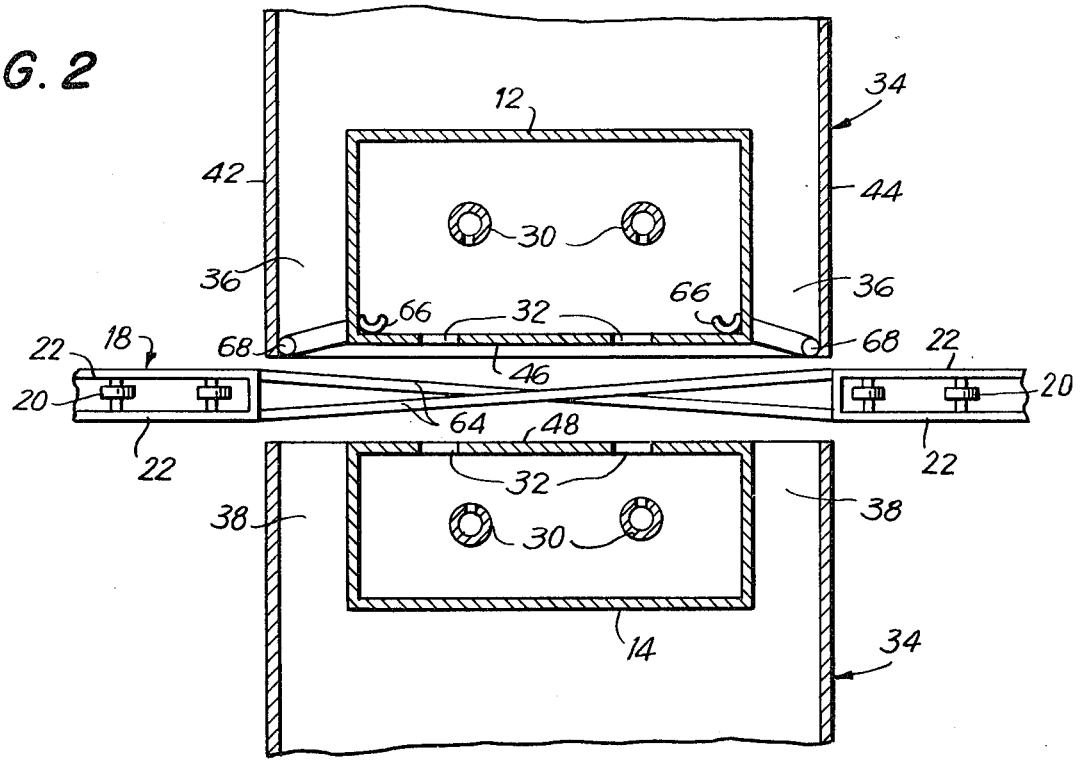
FIG. 2 is an enlarged side view, partly in cross section, of the steam box and duct arrangement constituting the steam zone of the machine.

Referring to the drawings, and particularly to FIGS. 1 and 2 thereof, the fabric conditioning machine of the invention comprises a frame 10 which is extended longitudinally in the direction in which the fabric is to be advanced as indicated by the arrow in FIG. 1. Frame 10 is constructed substantially identically on both sides so that for purposes of simplicity the description will be limited to a description of only one side thereof. Additionally, since the spreader for the fabric, the fabric advancing means and the arrangement of edge drive rolls are identical on both sides of the machine, FIG. 3 of the drawings has been drawn to depict such elements on only one side of the machine, it being understood that the arrangement of such elements on the other side of machine 8 the machine constitutes a mirror image of the arrangement depicted.

A pair of steam boxes 12, 14 is carried by frame 10 a distance downstream of a feed end 16 of the machine. Steam boxes 12, 14 are disposed in superposed vertically spaced relation, the spacing therebetween being dimensioned to allow for the mounting of a fabric advancing mechanism 18 for passage of the fabric between steam boxes 12, 14. Fabric advancing mechanism 18 (FIG. 3) consists of a series of rollers 20 mounted rotatably in plate-like longitudinally extending elements 22. An endless belt 24 is carried by rollers 20 and extends longitudinally from a location spaced but in close proximity to the downstream end of a fabric spreader 26 to be described to a location downstream of a cooling zone 28 of the machine.

Each steam box 12, 14 may have positioned therein a pair of steam pipes 30 (FIG. 2) for supplying steam to be applied to the fabric. At the extremity of each steam box 12, 14 closest to the spacing therebetween, there are formed one or more steam discharge means 32 which may simply take the form of orifices in the steam box. A duct 34 is provided for each of steam boxes 12, 14. Duct 34 for upper steam box 12 extends downwardly about upper steam box 12 to form a steam exhaust passage 36 therewith. Duct 34 terminates at its extremity at approximately the level of steam discharge means 32. Duct 34 for lower steam box 14 extends upwardly thereabout to form a steam exhaust passage 38 therewith. As duct 34 for upper steam box 12, duct 34 for lower steam box 14 terminates at its upper extremity at approximately the level of steam discharge means 32 for lower steam box 14. One or more blowers 40 (FIG. 1) communicate with ducts 34 for evacuation of steam upwardly through exhaust passage 36 and downwardly through exhaust passage 38 for discharge at a location away from the immediate vicinity of the machine. It will be understood, of course, that a common header may be employed to connect one or more blowers to ducts 34 as may be deemed advisable. The important consideration is that vacuuming of the steam should be from above and below the plane at which the fabric passes through the opening between the steam boxes, and that the rate of evacuation is to be so related to the rate at which steam is discharged from the steam boxes that there is no migration of steam horizontally beyond the sidewalls 42, 44 of the ducts. In this manner, the steam zone is confined to the region between discharge faces 46, 48 of the upper and lower steam boxes. Further, it will be recognized that although only a single pair of upper and lower steam boxes 12, 14 is shown, it is within the contemplation of the invention to provide a steam zone of increased length through the use of additional pairs of steam boxes.

As stated earlier, fabric spreader 26 (FIG. 3) is mounted on frame 10 of machine 8 the machine adjacent feed end 16 thereof and extends downstream to a location in the proximity of but upstream of steam boxes 12, 14. Fabric spreader 26 includes a series of rollers 50 carried on a framework 52 and an endless belt 54 movable over rollers 50. It will be appreciated that such arrangement of rollers 50 and endless belt 54 on a framework 52 is supported at each side of frame 10 of machine 8 the machine. As can be seen most clearly in FIG. 3, fabric spreader 26 diverges as it extends longitudinally downstream toward machine 8 the machine so as to effect a gradual stretching of the fabric to the desired width. Means (not shown) are provided between opposed frameworks 52 on either side for adjustment of the distance therebetween in order to regulate the width to which the fabric is spread. Fabric advancing mechanism 18 which includes plate-like longitudinally extending elements 22, rollers 20 and endless belt 24 is spaced longitudinally from fabric spreader 26 and effectively constitutes an extension thereof for transfer of the fabric thereto for passage through the steam and cooling zones.

Fabric spreader 26 and fabric advancing mechanism 18 are driven respectively by pairs of edge drive rolls 56, 58, which, in turn, may be driven by motors 60 (FIG. 4) either individually associated with edge drive rolls 56, 58 or through a common transmission system (not shown). Such drive system will not be described in detail since it is well within the skill of the ordinary mechanic to devise the necessary arrangement of shafts, sprockets and associated gearing.

Figure 3:
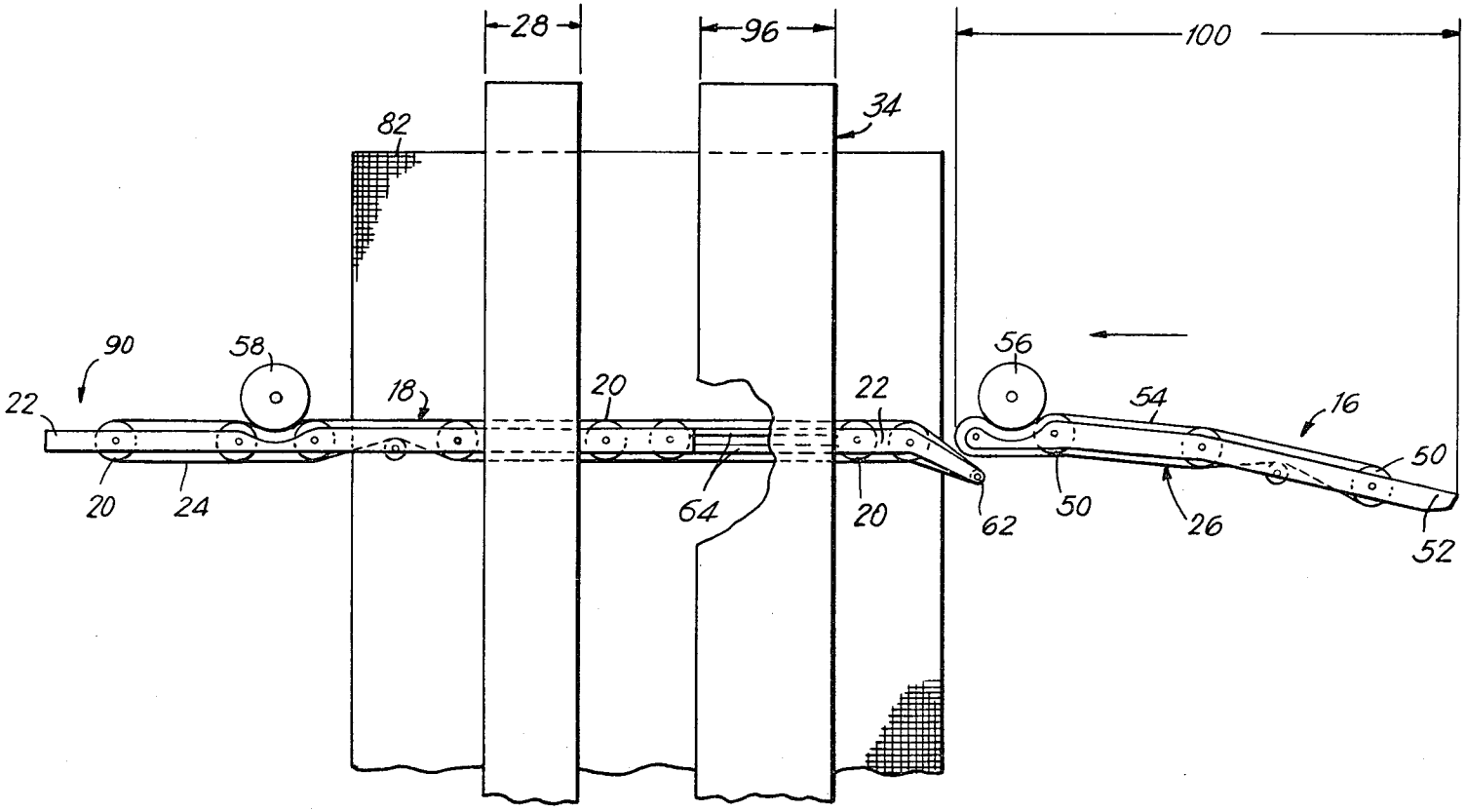
FIG. 3 is a fragmentary top plan view of the machine which has been shown in FIG. 1.

Referring to FIG. 3, it will be observed that the upstream terminus of belt 24 of fabric advancing mechanism 18 is directed diagonally inwardly so as to be offset from belt 54 of fabric spreader 26. An idler roller 62 may desirably be included on frame elements 22 to effect such offset. By transferring the fabric from fabric spreader 26 to fabric advancing mechanism 18 in this manner, it has been found that the phenomenon of bunching is substantially eliminated. Thus, the fabric is transferred smoothly from fabric spreader 26 to fabric advancing mechanism 18.

An advantageous feature of the machine of this invention stems from the use of separate edge drive rolls 56 and 58 for fabric spreader 26 and for fabric advancing mechanism 18, respectively. Edge drive rolls 58 are mounted so as to cooperate with rollers 20 of fabric advancing mechanism 18 at a location downstream of cooling zone 28. Also, the length of fabric advancing mechanism 18 is somewhat greater than that of fabric spreader 26. This arrangement permits processing of the fabric in a spread condition for a longer period of time than with earlier machines and leads to improved setting of the fabric. Further, due to the provision of separate edge drive rolls 56 and 58 for fabric spreader 26 and fabric advancing mechanism 18 and the increased length of endless belt 24, and the prevention of migration of steam from the steam zone because of the unique duct arrangement and evacuation from above and below, it has been found that belt temperatures throughout the machine are generally lower than with the machines of the prior art. Because of such lower belt temperatures, there is a significant reduction in the degree of marking, pressing and shining of the fabric even in regions of the machine upstream of the steam zone. It will, of course, be recognized that such a feature takes on added importance when heat-sensitive fabrics such as acrylics are to be processed.

Reference is now made to FIG. 2 of the drawings where another feature of machine 8 the machine is shown. As stated earlier, fabric advancing mechanism 18 includes plate-like longitudinally-extending elements 22 for rotatable support of rollers 20. In the region of the steam zone, elements 22 terminate and are replaced by pairs of stainless steel rods 64. By replacing plate-like longitudinally-extending elements 22 with rods 64, portions of the fabric which would otherwise be shielded against exposure to the steam within the steam zone are optimally treated. It is thus ensured that all areas of the fabric are steam conditioned to a uniform extent.

Referring to FIG. 2 of the drawings, it will be seen that there is provided within upper steam box 12 a conduit or channel 66 for the conveyance of condensate from within upper steam box 12 and its associated duct 34. Conduit 66 is desirably connected with a section 68 which is positioned in close proximity to sidewalls 42, 44 of upper duct 34 so as to effectuate heat exchange therewith and thereby heat sidewalls 42, 44 to a temperature above the dew point of the water vapor. Condensation on sidewalls 42, 44 is thus prevented, and the problem of dripping of condensate onto the fabric being processed is avoided.

Figure 4:
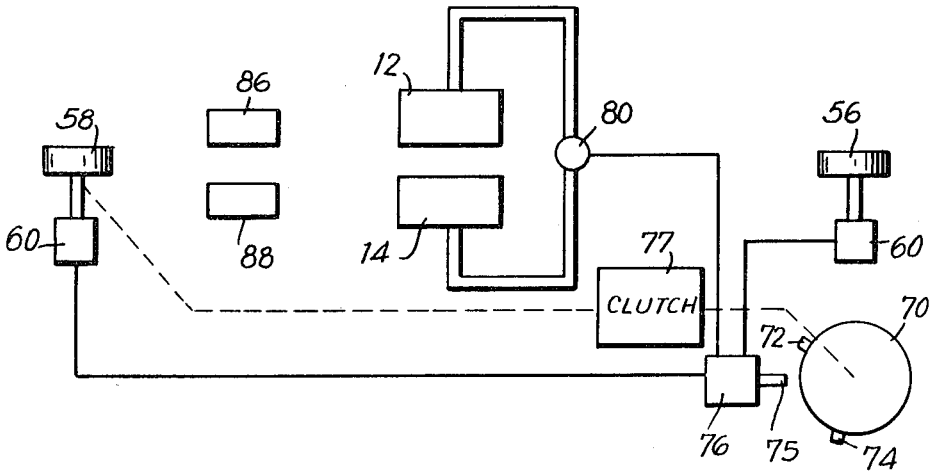
FIG. 4 is a schematic illustration of a control arrangement suitable for use with the apparatus of FIG. 1.

In FIG. 4, there is shown, in simplified form, a control system which may be employed with the machine of the invention. A timing chain 70 is concertedly driven with edge drive roll 58 by mechanical connection as indicated by a dashed line therebetween. A pair of pin elements 72, 74 are positioned on timing chain 70 in relation to the length of the sweater sections and the cuff portion thereof so as to enable control of a control circuit 76 operatively connected to one or more motors 60 and to steam valve 80. A proximity sensor 75, which may be of any convenient type such as a magnetic, acoustic, optical, electrostatic sensor, but is more preferably a Hall-effect sensor, senses the passage of pin elements 72, 74, which are preferably magnetic, therepast. By suitably adjusting the location of pin elements and switch member 76, it is possible to activate and deactivate motors 60 to control the driving of fabric spreader 26 and fabric advancing mechanism 18 for predetermined periods of time and to also shut off the steam to the steam boxes 12, 14 by control signals fed to a solenoid-operated steam valve 80 for coordinated periods of time. In this manner, the steam is shut off by steam valve 80 and motors 60 are deactivated whenever pin element 72 passes proximity sensor 75. This is mechanically arranged to occur when a sweater section arrives at a predetermined point upstream of the steam boxes. In a preferred embodiment, steam may be continued for a short time after motors 60 are stopped in order to avoid curling of the fabric at the end. Blower 40 exhausts steam from steam boxes 12 and 14 during the pause. After a second predetermined period of time determined by a timer (not shown) in control circuit 76, motors 60 are reactivated and the sweater section is again advanced. When pin element 74 passes proximity sensor 75, steam is again turned on. The point at which steam is turned on is mechanically arranged to occur after the cuff segment has passed through the steam zone and the next body segment of the continuous length of sweater fabric is advanced through the steam zone. Periodic stopping of the machine has been found to increase its effectiveness because cooling of the steam zone is permitted before the cuff segment (or other portion of the fabric not to be steamed) passes therethrough. This is thus a preferred form of the invention. However, it is within the ambit of the invention for control circuit 76 to continuously energize motors 60 and only shut off steam by deenergizing steam valve 80 during transit of the cuff segment through the steam zone. It is also within the contemplation of the invention to utilize sensing means such as a photocell to sense the arrival of the cuff segment at the predetermined location for shutting off of the steam supply until such cuff segment has traversed the steam zone. Other sensing and control mechanisms may also be employed if desired. In the arrangement depicted in FIG. 4, it is desirable to provide a clutch 77 on the drive input to timing chain 70 to permit retiming of the sequences during the run of sweater sections if so required. Clutch 77 is preferably an electrically operated device which can be controlled either manually or by signals from control circuit 76.

Figure 5:
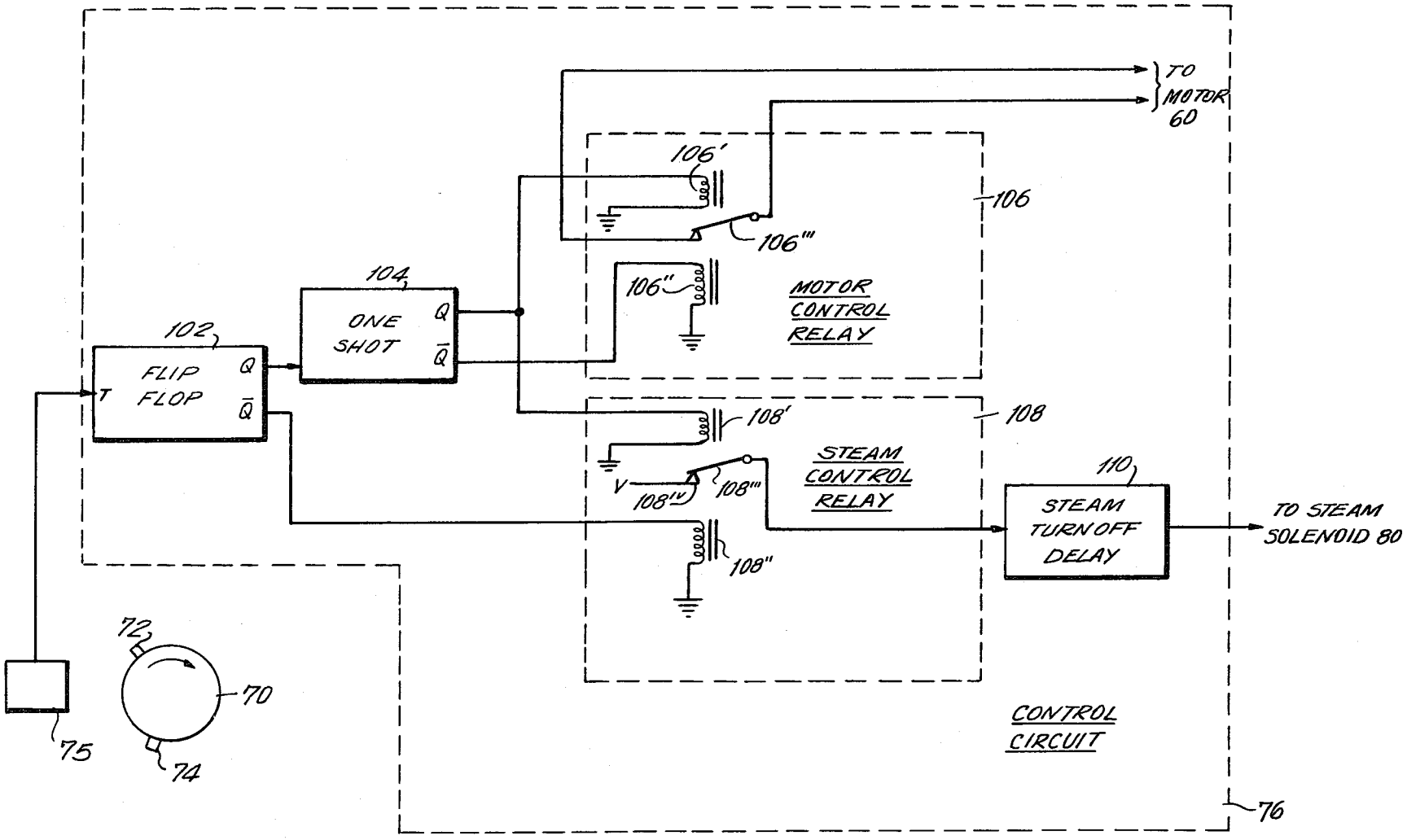
FIG. 5 is a simplified block diagram of a control circuit suitable for use with the control system of FIG. 4.

Referring now to FIG. 5, there is shown one embodiment of control circuit 76 which is suitable for use with apparatus of FIG. 4. As is well known, if proximity sensor 75 is a Hall-effect device and pin elements 72 and 74 are magnetic devices, proximity sensor 75 produces a sharply defined pulse each time one of pin elements 72 or 74 passes therepast. The sharply defined pulse is applied to a toggle input of a flip flop 102. A direct output Q of flip flop 102 thereupon changes to a logic 1 which is applied to an input of a one shot 104. A motor control relay 106 includes a first actuating coil 106′ and a second actuating coil 106″ which are alternately effective to actuate a movable contact 106″ between open and closed position, respectively. A direct output Q of one shot 104 is applied to relay coil 106′. An inverted output Q is applied to relay coil 106′. Thus, when one shot 104 is triggered, the 1 applied from its direct output $\overline{Q}$ to relay coil 106′ actuates movable contact 106‴ into its open position thus interrupting power to motor 60 (not shown in FIG. 5). At the end of the cycle of one shot 104, which may be adjusted between about 0.15 and about 15 seconds, the outputs of one shot 104 reverse their conditions thus energizing relay coil 106″ from the inverted output $\overline{Q}$ to thereby actuate movable contact 106‴ into its closed condition and thus reenergize motor 60.

A steam control relay 108 includes relay coils 108′ and 108″ as well as a movable contact 108‴. Steam control relay 108 is of the type in which movable contact 108‴ remains in its opened or closed position until actuated into its alternative position by energization of the appropriate one of relay coils 108′ and 108″. Direct output Q of one shot 104 is applied to relay coil 108′. Inverted output $\overline{Q}$ of flip flop 102 is applied to relay coil 108″. A supply voltage V is applied to a fixed contack $108^{IV}$. Movable contact 108‴ is connected to a steam turn-off delay 110 of a conventional type which, when it first receives voltage V from steam control relay 108 substantially immediately applies a control voltage to steam solenoid 80 to begin application of steam but, when voltage V is removed therefrom, steam turn-off delay 110 continues to provide a control signal to maintain steam solenoid 80 in the energized condition for an adjustable delay period which may extend, for example, for from about 0.1 to about 10 seconds.

As an initial condition for the description of the operation which follows, it is assumed that relay contacts 106‴ and 108‴ are closed thus operating motor 60 and steam solenoid 80 to provide steam conditioning. It is further assumed that pin element 72 has passed proximity sensor 75 and that timing chain 70 is rotating in the direction indicated by a curved arrow in FIG. 5. When pin element 74 passes proximity sensor 75, the output of proximity sensor 75 applied to toggle input T of flip flop 102 triggers flip flop 102 into its condition which produces a 1 at direct output Q. This 1 triggers one shot 104 into providing an output pulse which endures for a selected time between 0.15 and 15 seconds. The direct output Q of one shot 104, applied to relay coils 106″ and 108‴ actuates movable contacts 106″ and 108″ respectively into their open conditions. Thus, motor 60 is substantially immediately deenergized and voltage V to steam turn-off delay 110 is removed. Steam turn-off delay 110 continues to provide a signal to steam solenoid 80 for a short selectable period in order to complete the steam conditioning in the vicinity of a cuff. Steam turn-off delay 110 then times out and deenergizes steam solenoid 80. The flow of steam is thus terminated and the fabric being treated remains substantially motionless while blowers 40 (FIG. 1) exhaust the steam from the treatment area and contribute to cooling of the belt and other items in the vicinity of the steam. When the timing cycle of one shot 104 is completed, the 1 at direct output Q is removed and a 1 is applied from inverted output $\overline{Q}$ to relay coil 106″. This change has no effect on steam control relay 108 since no actuating signal is applied at this time to relay coil 108". Thus, movable contact 106''' is actuated to its closed position and motor 60 is energized to begin the transport of fabric past the cuff region in preparation for a next steam conditioning cycle. When pin element 72 is rotated into proximity of proximity sensor 75, flip flop 102 is triggered into its reset condition thus coupling a 1 from inverted output $\overline{Q}$ to relay coil 108". The change of state of flip flop 102 has no effect on one shot 104. Movable contact 108''' is actuated to its closed position thus applying voltage V to steam turn-off delay 110 and therethrough actuating steam solenoid 80 to initiate the flow of steam. Thus, both motor 60 and steam solenoid 80 are in the energized conditions which are assumed at the beginning of this description. This cycle is repeated for automatic steam conditioning of connected fabric lengths.

Figure 6:
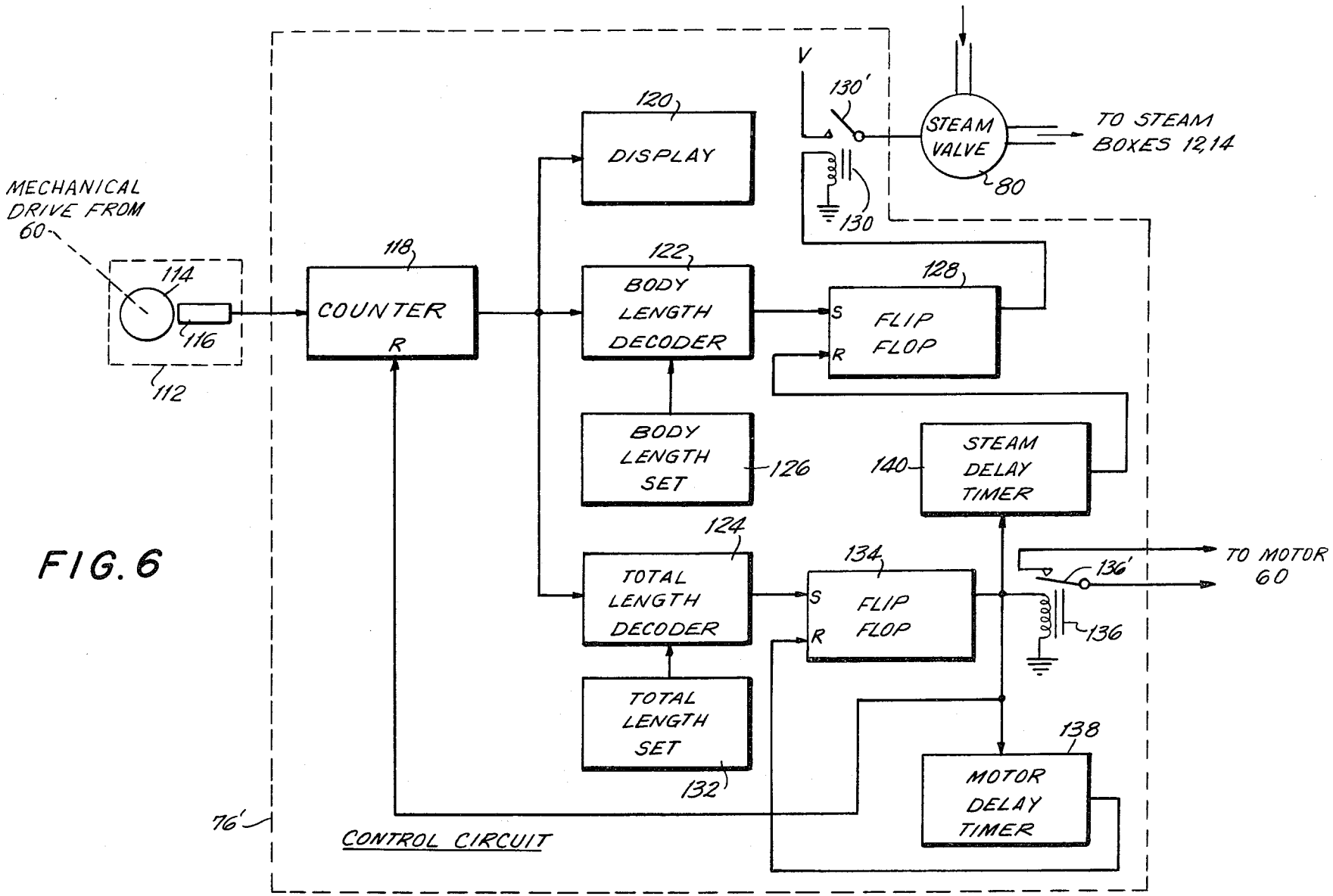
FIG. 6 is a block diagram of a further control circuit which is satisfactory for use with the control system of FIG. 4.

Referring now to FIG. 6, a further embodiment of a control circuit 76' is shown which may be employed in the control system of FIG. 4. A pulse generator 112, which may be of any convenient type, produces a pulse each time motor 60 performs a predetermined portion of a revolution. In the preferred embodiment, pulse generator 12 includes a toothed disc 114 which rotates adjacent a sensor 116. Toothed disc 114 may be permanently magnetized or may be of magnetic or other material and sensor 116 may be of any convenient type capable of sensing the passage of individual teeth on toothed disc 114. Pulse generator 112 is conventional and does not constitute a patentable part of the present invention and will thus not be further described. For convenience, it is assumed that sensor 116 produces a pulse for each 0.1 inches of motion of fabric on fabric advancing mechanism 18 (FIG. 3).

The pulses from pulse generator 112 are applied to an input of a counter 118. The condition or contents of counter 118 are applied to a display 120, a body length decoder 122 and a total length decoder 124.

A body length set control 126 may be manually adjusted to set a selected body length which is applied to body length decoder 22. When the content of counter 118 applied to body length decoder 122 equals the setting of body length set control 126, body length decoder 122 applies a trigger signal to the set input S of a flip flop 128. Flip flop 128 produces an output which energizes a steam control relay 130 to thus close contact 130' thereof whereby a control voltage V is applied to steam valve 80 to thereby begin steaming of a garment.

A total length set control 132 can be manually adjusted to represent the total garment length and applies this value to total length decoder 124. When counter 118 attains a count equal to that supplied to total length set control 132, total length decoder 124 provides a trigger output which is applied to the set input S of a flip flop 134. Flip flop 134 thereupon applies an energizing voltage to motor control relay 136 which thereupon opens contacts 136' thereof and thus deenergizes motor 60. In addition, the output of flip flop 134 is applied to a reset input R of counter 118 to thus reinitialize counter 118, to a motor delay timer 138 and to a steam delay timer 140.

In the condition attained in the immediately preceding discussion, steam control relay 130 remains closed to provide steam to steam boxes 12 and 14 while motor control relay 136 is opened to deenergize motor 60. After a variable delay, steam delay timer 140 applies a trigger signal to the reset input R of flip flop 128 to thereby deenergize steam control relay 130 and to terminate the flow of steam to steam boxes 12 and 14. Blowers 40 (FIG. 1) continue to run to exhaust steam from steam boxes 12 and 14 at this time.

After an additional delay, motor delay timer 138 times out and applies a trigger signal to the reset input R of flip flop 134. Motor control relay 136, being deenergized by this condition, enables motor 60 to begin operation. Counter 118 thereupon begins counting pulses from pulse generator 112 and, when the number set into body length set control 126 is reached, flip flop 128 again energizes steam control relay 130 to begin the steaming portion of the cycle.

Referring to FIGS. 1 and 3, there is shown a belt conveyor 82 for support of the length of fabric throughout substantially its entire passage through fabric conditioning machine. Belt conveyor 82 thus may extend from feed end 16 at a location upstream of the steam zone to a point downstream of the cooling zone. By supporting the fabric throughout its passage through the steam and cooling zones, distortion of the fabric is prevented while it is in a plastic state and not yet dimensionally stabilized. Belt conveyor 82 is carried by a plurality of rolls 84 which are driven in synchronism with edge drive rolls 56 and 58 through a conventional common drive arrangement (not shown). Preferably drive motors 60 are of the D.C. type in order to allow a wide range of speed control.

It will be understood that the drive speed of edge drive rolls 56, 58 may be varied so as to afford different linear speeds for endless belts 24 and 54 of fabric advancing mechanism 18 and fabric spreader 26, respectively. Such speed control allows accurate regulation of the degree of longitudinal relaxation or tension of the fabric and also facilitates transverse alignment of the fabric to ensure that the desired dimensional sizing widthwise and lengthwise is obtained.

In FIGS. 1 and 3, cooling zone 28 may include upper and lower nozzles 86, 88 supported on frame 10. The fabric is passed through cooling zone 28 in a completely relaxed condition so that by the time the fabric arrives at a discharge end 90 of the machine, the fabric is fully dimensionally stable. A take-out mechanism 92 is desirably provided for folding or rolling the conditioned fabric. Such mechanisms are conventional and need not be described herein.

Immediately upstream of fabric spreader 26, there is provided a tapered wire guide member 94 which terminates at its downstream end at the upstream extremity of fabric spreader 26. Guide member 94 facilitates positioning and feeding of the fabric onto fabric spreader 26 in a smooth and continuous manner.

The process is performed as follows. The fabric is threaded over an entry roll and over guide member 94. The machine is activated so as to drive edge drive rolls 56, 58 and the fabric advancing mechanism 18 and spreader 26. The fabric passes around belt 54 of fabric spreader 26 and is advanced sequentially through steam zone 96 and cooling zone 28. As the fabric traverses fabric spreader 26, it is spread in spreading zone 100 to the desired width. When the fabric is a knitted tubular sweater fabric, it is flattened as it progresses along fabric spreader 26. As stated previously, the spaced distance between the opposed frames of fabric spreader 26 and fabric advancing mechanism 18 are adjusted to conform with the desired width of the fabric. A rear take-out roll (not shown) is desirably provided and furnished with a control such that its speed may be varied. After the fabric is fed to the machine, the speed of the rear take-out roll and that of the front edge drive rolls 56, 58 are regulated to establish the desired running condition for the fabric. Timing chain 70 operates in cooperation with proximity sensor 75 and control circuit 76 to control the admission of steam to steam zone 96, and the interruption of the machine drive and of the steam supply so that successive cuff segments are not subjected to steam treatment within steam zone 96. As the fabric passes through steam zone 96, blowers 40 are in operation continuously evacuating steam through steam exhaust passages 36 and 38 of the duct system 34 and preventing the migration of steam outside of the area within the ducts. The fabric passes from steam zone 96 to and through cooling zone 28 and thereafter is recovered in dimensionally stable condition on suitable collecting apparatus such as a subway-type folding device or rolling apparatus.

From the foregoing, it will be seen that apparatus has been provided as well as a process for the steam conditioning of continuous lengths of textile fabric which ensures protection of selected segments of the fabric against inadvertent exposure to steam treatment by confining the steam zone to a circumscribed region between upper and lower steam boxes 12 and 14 and by controlling in timed sequence the supply of steam to steam zone 96 and the advancement of the fabric through the machine. Dimensional stability of the treated fabric has been brought under more accurate and reliable control, edge creasing, wale separation and the production of shine marks have been eliminated. Further, the edge drive system with its variable speed control affords complete yield and cross line control.

Although the invention has been described in specific terms, it will be understood that various changes may be made in size, shape, materials and in the arrangement of the parts without departing from the spirit and scope of the invention as claimed.

What we claim is:

1. An apparatus for steam conditioning a fabric comprising:

means for spreading said fabric in at least a transverse direction;

an upper steam box spaced a first predetermined distance above the upper surface of the entire transverse dimension of the spread fabric;

a lower steam box spaced a second predetermined distance below the lower surface of the entire transverse dimension of the spread fabric and in superposed relationship to said upper steam box;

first steam means centered in said upper steam box and spaced said first predetermined distance above said upper surface for discharging steam in a first steam line across said entire transverse dimension of said upper surface;

an upper steam exhaust passage adjacent said first steam means along at least the entire length of said first line, said upper steam exhaust passage defining an outer boundary of said upper steam box;

blower means effective to withdraw substantially all of said steam delivered by said first steam means above said surface through said upper steam exhaust passage whereby said steam is prevented from migrating horizontally and is confined to at most said outer boundary of said upper steam exhaust passage;

second steam means centered in said lower steam box and spaced said second predetermined distance below said lower surface for discharging steam in a second line across said entire transverse dimension of said lower surface;

a lower steam exhaust passage adjacent said second steam means along at least the entire length of said second line, said lower steam exhaust passage defining an outer boundary of said lower steam box;

said blower means being further effective to withdraw substantially all of said steam delivered below said surface by said second steam means through said lower exhaust passage whereby said steam is prevented from migrating horizontally and is confined to at most said outer boundary of said lower steam box;

means for providing relative motion between said fabric and said upper and lower steam boxes in a direction at right angles to said transverse direction whereby said first and second lines are moved relative to said fabric; and means for stopping said relative motion and said first and second means for delivering steam at a predetermined relationship of said fabric and upper and lower steam boxes whereby at least a predetermined portion of said fabric outside said outer boundaries of said upper and lower steam boxes remains free from said steam conditioning.

2. Apparatus according to claim 1, wherein said means for spreading includes a frame, first and second series of rollers and associated endless belts disposed respectively on opposed sides of said frame and extending longitudinally thereof from a feed end thereof to a location upstream of said upper and lower steam boxes; said means for providing relative motion includes fabric advancing means comprising third and fourth series of rollers and associated endless belts disposed respectively on opposed sides of said frame and extending longitudinally thereof from a location spaced from but in close proximity to the downstream end of said fabric spreader to a location downstream of said upper and lower steam boxes; and first and second pairs of edge drive rolls carried by said frame, the first pair of said edge drive rolls being drivably cooperable with rollers of said fabric spreader and the second pair of edge drive rolls being drivably cooperable with rollers of said fabric advancing means at a location downstream of said upper and lower steam boxes.

3. Apparatus according to claim 1 or 2, including conduit means for conveying condensate from within said upper steam box to a location remote therefrom and externally of said upper steam exhaust passage, said conduit means extending along a path at least a portion of which is in sufficiently close proximity to outer sidewalls of said upper steam exhaust passage so as to effectuate heat exchange therewith to thereby avoid condensation on the surfaces of said sidewalls and consequent staining of the fabric being processed.

4. Apparatus according to claim 2, wherein said fabric advancing means includes a spacing between opposed endless belts thereof substantially equal to a spacing of opposed endless belts of said downstream end of said fabric spreader so that said fabric advancing means constitutes an extension of said fabric spreader, said associated endless belts on said third and fourth series of rollers terminating respectively at locations diagonally inwardly and upstream of the adjacent ends of the belts of said first and second series of rollers, whereby transfer of the fabric from the belts of said fabric spreader to the belts of said fabric advancing means is smoothly facilitated and bunching of the fabric during such transfer is substantially eliminated.

5. Apparatus according to claim 2, including longitudinally extending plate-like elements carried by said frame on the opposed sides thereof for rotatably mounting said third and fourth series of rollers, said plate-like elements extending from the upstream end of said fabric advancing means to a location proximate to but upstream of said steam boxes and from the downstream end of said fabric advancing means to a location proximate to but downstream of said steam boxes, the portion of said fabric advancing means within the steam zone of the apparatus comprising an open network of rod elements connected diagonally between said plate-like elements, whereby the fabric passing through the steam zone is optimally exposed to the steam therewithin with minimal contact with metallic members.

6. Apparatus according to claim 1, wherein said means for stopping includes means for establishing cyclical regulation of the steam supply to said steam boxes and said means for providing relative motion controlling the advancement of fabric between said steam boxes, said means coordinating said steam regulation and means for providing relative motion in a predetermined pattern.

7. An apparatus for steam conditioning a fabric comprising:

means for spreading said fabric in at least a transverse direction;

an upper steam box spaced a first predetermined distance above the upper surface of the entire transverse dimension of the spread fabric;

a lower steam box spaced a second predetermined distance below the lower surface of the entire transverse dimension of the spread fabric and in superposed relationship to said upper steam box;

first steam means centered in said upper steam box and spaced said first predetermined distance above said upper surface for discharging steam in a first steam line across said entire transverse dimension of said upper surface;

an upper steam exhaust passage adjacent said first steam means along at least the entire length of said first line, said upper steam exhaust passage defining an outer boundary of said upper steam box;

blower means effective to withdraw substantially all of said steam delivered by said first steam means through said upper steam exhaust passage whereby said steam is prevented from migrating horizontally and is confined to at most said outer boundary of said upper steam exhaust passage;

second steam means centered in said lower steam box and spaced said second predetermined distance below said lower surface for discharging steam in a second line across said entire transverse dimension of said lower surface;

a lower steam exhaust passage adjacent said second steam means along at least the entire length of said second line, said lower steam exhaust passage defining an outer boundary of said lower steam box;

said blower means being further effective to withdraw substantially all of said steam delivered by said second steam means through said lower exhaust passage whereby said steam is prevented from migrating horizontally and is confined to at most said outer boundary of said lower steam box;

means for providing relative motion between said fabric and said upper and lower steam boxes in a direction at right angles to said transverse direction whereby said first and second lines are moved relative to said fabric;

means for stopping said relative motion and said first and second means for delivering steam at a predetermined relationship of said fabric and upper and lower steam boxes whereby at least a predetermined portion of said fabric outside said outer boundaries of said upper and lower steam boxes remains free from said steam conditioning;

at least one valve for controlling the admission of steam to said steam boxes;

at least one electric motor for driving said means for providing relative motion;

said means for stopping including a timing chain having pin elements thereon for respectively activating and deactivating said steam control valve and said at least one electric motor in a predetermined cyclical pattern; and electric switch means actuatable by said pin elements and connected operably to said steam control valve and to said at least one electric motor.

8. Apparatus according to claim 7, wherein said pin elements and electric switch means includes means to effect operation in consecutive cycles each of which sequentially interrupts the steam supply to said steam boxes and deactivates said at least one electric motor upon the arrival of selected segments of the fabric at a predetermined location adjacent the upstream extremity of the steam zone, maintains such steam supply interrupted and the at least one electric motor deactivated for a first predetermined period of time, reactivates the at least one electric motor, and after a second predetermined period of time following reactivation of the at least one electric motor continues the admission of steam to said steam boxes.

9. Apparatus according to claim 8, wherein said pin elements and electric switch means are effective to continue said steam supply for a predetermined steam delay after stopping said at least one electric motor.

* * * * *